US005716568A

United States Patent [19]

Kaegi et al.

[11] Patent Number: 5,716,568

[45] Date of Patent: Feb. 10, 1998

[54] METHOD FOR PRODUCING POLYESTER BI-COMPONENT FIBERS AND FILAMENTS

[75] Inventors: Werner Kaegi, Domat/Ems; Werner Stibal, Trimmis, both of Switzerland

[73] Assignee: EMS-Inventa AG, Zurich, Switzerland

[21] Appl. No.: 643,568

[22] Filed: May 6, 1996

[30] Foreign Application Priority Data

May 11, 1995 [DE] Germany ..... 195 17 350.3

[51] Int. Cl.[6] ..... D01F 8/14; D02G 3/00

[52] U.S. Cl. ..... 264/103; 264/168; 264/171.26; 264/172.14; 264/172.15; 264/172.17; 264/210.5; 264/210.6; 264/210.8; 264/235.6

[58] Field of Search ..... 264/103, 168, 264/171.26, 172.14, 172.15, 172.17, 210.5, 210.6, 210.8, 235.6

[56] References Cited

U.S. PATENT DOCUMENTS 3,408,433 10/1968 Brayford ..... 264/172.14
3,671,620 6/1972 Inoue ..... 264/172.17
3,927,167 12/1975 Reese ..... 264/210.5
4,990,297 2/1991 Stibal et al. ..... 264/211.14

FOREIGN PATENT DOCUMENTS 80515 3/1971 Germany .

OTHER PUBLICATIONS

Ullmann's Encyclopedia of Industrial Chemistry, vol. A10 (1987), pp. 511–516.

*Primary Examiner*—Leo B. Tentoni
*Attorney, Agent, or Firm*—Browdy and Neimark

[57] ABSTRACT

A method for producing polyester bi-component threads on the basis of only one type of polyester is carded out by an "in line" modification of a partial stream with a co-monomer from the substance class of lactones, spinning of the unmodified and modified partial melt stream by means of a bi-component spinneret pack to form bi-component threads, and their further processing and use.

22 Claims, 1 Drawing Sheet

METHOD FOR PRODUCING POLYESTER BI-COMPONENT FIBERS AND FILAMENTS

FIELD OF INVENTION

The present invention relates to synthetic fibers, and in particular relates to improvements in polyester textile fibers, and especially a novel method for producing polyester bi-component fibers and filaments from the modified and unmodified melt of one and the same polyester, and to the fibers and filaments which can be produced by means of this novel method.

BACKGROUND

The development of the first synthetic bi-component fibers and of the special spinnerets and the methods required to produce such bi-component fibers was started approximately 40 years ago. Such fibers are composed of two polymers of different chemical and/or physical structures which are connected with each other. Depending on the geometric arrangement of the two components in the fiber, distinctions between the types of side- by-side (S/S), core/cover (C/C) and matrix/fibrils (M/F) are made. Polymerswhich are of different types, the same types or modified can be considered as components. The following types of material pairings are known in the field of polyesters:

- two different homo-polyesters, for example PET (polyethylene terephthalate) and PBT (polybutylene terephthalate), or PET and PPT (polypropylene terephthalate)
- one homo-polyester and one copolyester,
- two different co-polyesters,
- two polyesters of the same chemical composition, but of different solvent viscosity, The first three combination options have the disadvantage that respectively two different polyesters are required for this, which must be stored, processed and melted in separate systems, i.e. two crystallizers, two dryers and two extruders are required. Added to this are the problems of crystallization and drying of copolyesters, which become clearly more tacky beginning with only a few mol-% of comonomer parts and which, in the case of amorphous copolyesters, can only be dried below their glass transition temperature, which results in very long drying times.

The fourth option can also be performed "in line" (see DD 80515 or the equivalent ZA 6904544) or as in DE 1 938 291 or its equivalent U.S. Pat. No. 3,671,620, wherein an intermediate product melt stream of low viscosity is branched off the polycondensation system in a continuous direct spinning system.

A further process variant consists in lowering a partial polyester stream to the desired low viscosity by glycolysis in that ethylene glycol, for example, is metered into the corresponding melt pipe or into the separate melt extruder. The "two viscosities" variant is only used in the production of self-crimping fibers and filaments. However, this is problematical, since the melt stream bends when exiting the capillaries of the spinneret because of the different, side-by-side located viscosities. If a defined critical viscosity difference is exceeded, spinning no longer can take place because at that point the fibrils are bent so strongly that they adhere to the nozzle plate. For example, hollow SIS PET fibers can still be safely spun at a maximum difference in relative viscosity (with the same melting temperature of the two halves) of 0.10 (relative viscosity measured at 1% in m-cresol at 20° C., for example initial viscosity=1.60 and degraded viscosity of the partial stream=1.50). With S/S fibers which are not hollow, the permissible difference is even less for reasons of physics.

To realize spinning at greater viscosity differences, it has been proposed to make the nozzle openings asymmetric in such a way that the melt fiber side with the lower viscosity has the greater contact surface with the inner wall of the bore in order to slow the flow speed on that side in such manner and to prevent diversion (see GB 1 091 367 or its equivalent U.S. Pat. No. 3,408,433). However, such nozzle plates are too expensive, both because of their special construction and, in operation, because of the reduced hole density, i.e. reduced number of threads produced.

The use of caprolactone as a possible co-component for co-PET for producing filaments with greater shrinking is mentioned in U.S. Pat. No. 3,927,167. However, the subject of this patent is a mixed yarn, which becomes bulky with heat treatment and is obtained by a combination of simultaneously, but separately melt-spun individual PET and co-PET threads into a yam. This patent does not pertain to bi-component spinning, and the co-PET granules are produced in the conventional manner.

SUMMARY OF INVENTION

It is an object of the invention to develop a cost-effective method which generally simplifies the production of polyester bi-component threads and thereby makes them more economical for industrial production, and improves the spinnability of the S/S types at the nozzle. In general, bi-component fibers and filaments are produced by means of "in line" modification of a partial stream with a co-monomer from the substance class of lactones, and spinning of the unmodified and modified melt stream by means of at least one bi-component spinneret pack.

Based on only one and the same basic type of polyester, and in accordance with the present invention, a portion of the melt is continuously modified "in line" with a lactone co-monomer prior to spinning, and the modified and unmodified melt streams are supplied to one or several bi-component spinneret packs and spun into hi-component threads and, in the case of S/S fiber cables, self-crimping is performed at the end.

It was surprising that only a single polymer was sufficient, in place of the two required polymers up to now, and that in spite of this, bi-component threads suitable for the intended use were obtained without production problems. In spite of the "in line" modification of a partial stream required by the invention, the viscosity difference with the unmodified polyester must not exceed certain limits, as mentioned, and at the same time it must be possible to perform the modification within a very short time, i.e. in less than 30 minutes, and the polymer properties must change to a sufficient degree in the process.

Lactones capable of reaction, in particular ε-caprolactone, have surprisingly shown themselves to be suitable for the modification of polyester during bi-component spinning. Introduced as a monomer into the polyester melt, lactones which are suitable in accordance with the present invention react under pressure with the polyester in a surprisingly short time, i.e. less than 30 minutes, at unusually high temperatures, which are per se considered to be harmful in accordance with the prior art, of more than 260° C., in particular 265° to 310° C., preferably 270 to 295° C., and form a co-polyester. The reaction time for modification is preferably maximally 20 minutes, and particularly preferred are 3 to 15 minutes.

Further than that, in the present process the relative viscosity as a measure for the molecular weight remains surprisingly constant and the melt viscosity decreases only slightly. In accordance with the invention, the mutual processing of modified and unmodified polyesters is possible for the first time for the smallest units of a product structure (bi-component threads), wherein a relatively strong "in line" modification is possible in bi-component spinning, without interfering with the spinnability because of a too strong bending of the threads exiting the nozzle.

BRIEF DESCRIPTION OF DRAWING

An advantageous embodiment of the novel method principle for producing polyester bi-component threads according to the present invention is schematically represented in FIG. 1.

DETAILED DESCRIPTION OF EMBODIMENTS

Figure 1:
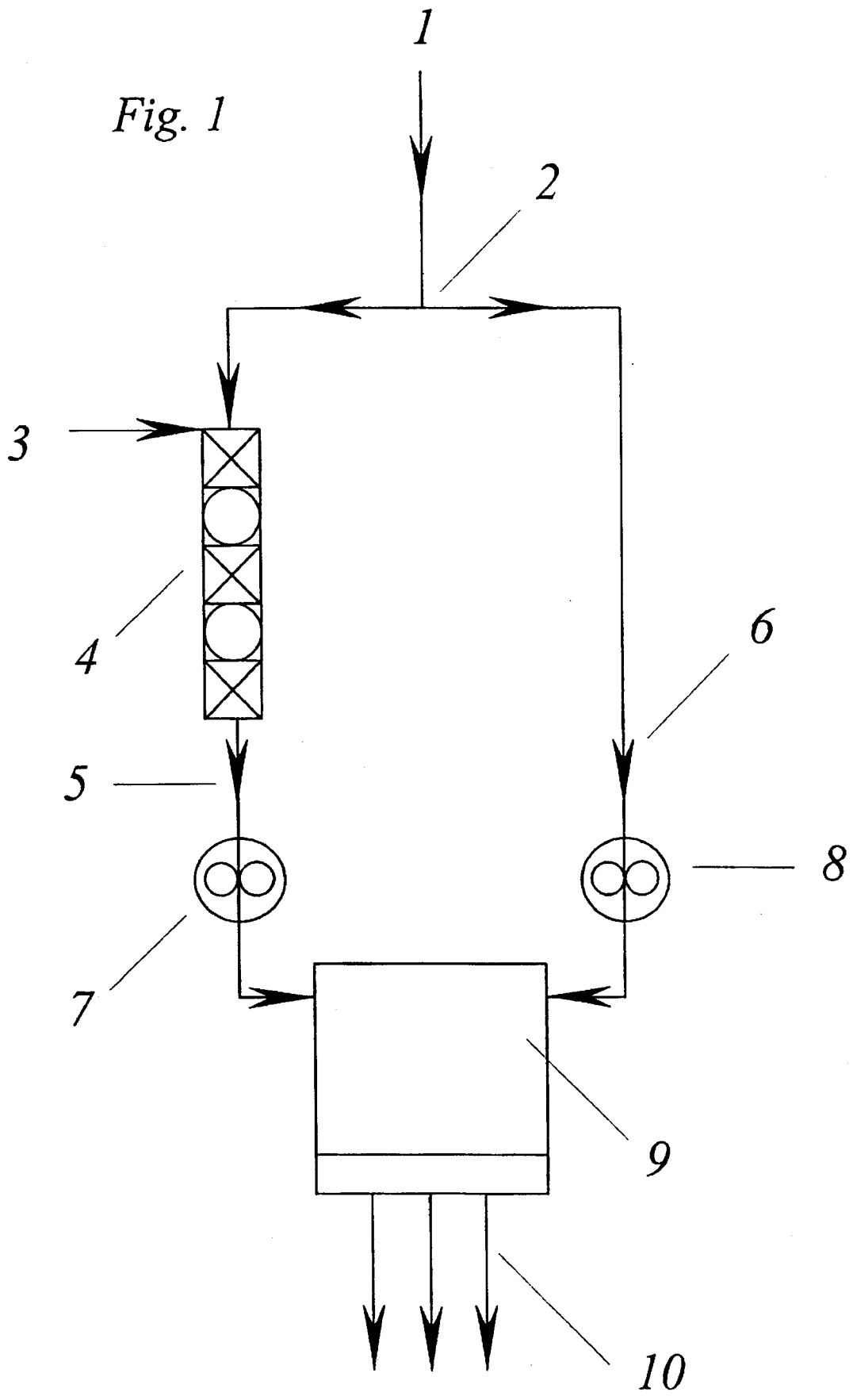

FIG. 1 is thus a schematic view of a preferred system according to the present invention wherein the reference numerals indicate:

1 Polyester melt stream

2 Branching of the stream 1 into two partial streams

3 Metering in the lactone into the partial stream to be modified

4 Static mixer

5 Modified partial stream (copolyester)

6 Unmodified partial stream

7 Spinning pump for the modified partial stream

8 Spinning pump for the unmodified partial stream

9 Spinneret pack with spinneret for bi-component spinning

10 Bi-component threads (initially in the form of a melt)

The polyester stream 1 preferably is constituted by polyester terephthalate (PET) with at least 90, preferably 95 or more, mol-% of ethylene terephthalate units. This stream either comes from a continuous poly-condensation (during direct spinning) or from an extruder (with extruder spinning based on granules). Branching 2 preferably takes place in the melt; if there is a conventional bi-component installation with two melt extruders the polyester granules can be distributed to the two extruders (or the associated dryers) as this corresponds to branching. Metering at point 3 of the lactone, preferably ε-caprolactone, into the partial stream to be modified preferably takes place in the melt pipe at the start of the static mixer 4, in the case of two extruders, but pressureless metering into the granule inlet of the one extruder can also be carried out according to the present invention.

Processing—and/or application-stipulated additives, such as catalysts, stabilizers, dyes and UV brighteners, can selectively be dissolved in the lactone. Catalysts for speeding up ring-opening and the insertion reaction are preferably added to the lactone, for which tin (II) compounds such as tin (II) dioctoate, or zirconium (IV) compounds, such as zirconium (II) acetylacetonate, are particularly suitable.

The modified partial stream 5, a lactone co-PET, is formed by reacting the lactone with the polyester melt. Like the unmodified partial stream 6, it is supplied by means of spinning pumps 7 or 8 to the bi-component spinneret pack 9. In a production installation it is of course also possible to distribute the two melt streams 5 and 6 to several spinneret packs 9 by means of an appropriate number of spinning pumps 7 or 8. The ratio of the two streams 5 and 6 set by means of the spinning pumps is approximately 1:1 in many applications. Depending on the pressure drop in the static mixer 4, it is sometimes also advantageous to arrange the spinning pump 7 upstream instead of downstream of the static mixer.

The bi-component spinneret pack 9 with the spinneret is of an arbitrarily suitable construction for generating strand profiles such as the S/S, S/S hollow or C/C configurations. S/S hollow is a profile as represented, for example, in FIG. 2 of DD 80 515 and ZA 69 04544. The appropriate bi-component melt threads or filaments 10 exit from the spinneret and are then cooled in accordance with known methods, and thus solidified into threads, and subsequently processed in one or two stages into for example textile or carpet fibers or filaments having the desired use properties. Further processing of the threads into fibers or filaments is performed in a manner known per se, such as described in Ullmann's Encyclopedia of Industrial Chemistry, 5th Ed., Vol. A10, Fibers, 3rd General Production Technology, pp. 511 to 566, D-Weinheim, 1987. Following melt spinning, the general processing steps consist of drawing, crimping and heat treatment. The methods and machines are different, depending on whether fibers or filaments (endless multifilaments) are involved. As a rule, fibers are produced in two stages, i.e. drawing separately from spinning, and are of course cut at the end.

The finished fibers or filaments can be further processed in turn for producing various articles and their applications.

Preferred variants and applications of fibers or filaments produced from the bi-component threads in accordance with the invention are, for example, with low partial stream modification, preferably approximately 4 to 12 mol-% of lactone, self-crimped SIS hollow fibers for use as filler fibers, or most preferably not more than about 11.5 mol-% lactone,self-crimped S/S filament yarns for producing curtains or fabrics. At increased modification, preferably approximately 20 to 40 mol-% of lactone, hot-melt adhesive fibers are obtained in the core/cover configuration (with the co-PET as the cover), also called binder fibers, for the thermal reinforcement of nonwovens, or analogously hot-melt adhesive filaments, In connection with the low modification, but even more so with high modification filaments, a large advantage of the method in accordance with the present invention lies in that crystallization and drying of the tacky copolyester, which is difficult in actuality, can be omitted.

The following examples are offered illustratively:

EXAMPLE 1

Dulled PET granules of the textile type M760 of EMS-CHEMIE AG constituted the base polymer. This textile standard polyethylene terephthalate has a relative viscosity of 1.60 (measured 1% in m-cresol at 20° C.) and contains 0.4 weight-% of $TiO_2$ (titanium dioxide) as the dulling pigment. The granules were distributed on the two dryers respectively of melt extruders of a conventional bi-component fiber pilot spinning machine. ε-caprolactone (obtained from SOLVAY INTEROX LTD.) was metered into the granule inlet connector (at the flange between the pipe from the dryer to the extruder) of the one extruder by means of a liquid metering pump. After the ε-caprolactone concentration in respect to crimping properties and amount used had been optimized in prior tests, a metered amount of 8 mol-% (corresponds to 4.9 weight-%) in relation to the co-PET after modification (i.e. to the amount of throughput of the corresponding component at the spinneret) was set in the main run. The modified and the unmodified polyester partial streams were supplied at a ratio of 1:1 to the bi-component spinning nozzle manifold by means of spinning pumps, wherein the residence time of the melt during modification was approximately 15 minutes.

The same relative viscosity was measured at samples of the two partial streams, i.e. no reduction of the molecular weight resulted from the modification in accordance with the invention. A spinneret pack of the construction described in DE 40 22 898 A1 and its equivalent U.S. Pat. No. 5,196,211 was used for spinning, however, without the K/M intermediate plate claimed therein, because side-by-side spinning, namely hollow (with an appropriate spinneret with ϵ-profiles), was carried out in the instant example. The temperature of the spin melts was 280° C., and the total spinneret throughput was 1310 g/min. The 790 threads total were cooled under the spinneret by means of a central cooling device (see DE 37 08 168 C2 and its equivalent U.S. Pat. No. 4,990,297), were taken off at 1170 m/min and placed in a can. Finished staple fibers were subsequently produced from the spinning material on a pilot fiber line.

EXAMPLE 2

A filament yarn was obtained on a bi-component filament pilot plant analogously with Example 1. Dulled PET granules of the type M762 of EMS-CHEMIE AG were employed as the starting material, having a relative viscosity of 1.62 (measured 1% in m-cresol at 20° C.). ϵ-caprolactone in an amount of 8 mol-% (relating to the co-PET) was metered in the granule inlet connector of the one extruder. Spinning was performed side-by-side at a component ratio of 1:1 by means of a bi-component spinneret pack with 26 holes and a total throughput of 44 g/min. In this case the melt residence time of the modification was approximately 25 minutes and the melt temperature 294° C. The same relative viscosity, namely 1.585, was measured for melt samples from both partial streams, i.e. no additional reduction could be noted in the modified partial stream in comparison with the unmodified stream. Although the bending of the full threads when exiting the nozzles was greater than in Example 1 with the hollow threads, it was without any technical spinning problems.

Only when starting from as much as approximately 12 mol-% of ϵ-caprolactone did the threads adhere to the spinneret when the thread tension was removed. In the actual spinning test with 8 mol-% of ϵ-caprolactone the threads were wound up at 3200 m/min following cooling, which resulted in a POY yarn of a titer dtex 138 f 26. After drawing at a ratio of 1:1.667 in a heating channel at approximately 170° C., intense crimping developed in the bi-component yarn, which could even be increased by subsequent tensionless heat-setting.

EXAMPLE 3

This time, core/cover bi-component threads were spun, again on the fiber bi-component pilot installation as in Example 1, i.e. with the C/C preliminary plate in the spinneret pack in accordance with DE 40 22 898 A1 and a spinneret with 790 circular holes. The PET granules were the same as in Example 1. However, the partial stream for the cover component was modified with 30 mol-% of ϵ-caprolactone (in relation to the co-PET), wherein tin (II) dioctoate at a concentration of 100 ppm in relation to the elementary tin had been dissolved as catalyst. In spite of the strong modification, the threads exiting the nozzles of the remained straight to a large degree because of their concentric cross section. The total throughput was set to 980 g/min (2×490 g/min), which corresponded to a melt residence time of approximately 20 minutes at a temperature of 280° C. The threads were cooled by means of a central quenching unit, taken off at 1200 m/min and stored in a can. Subsequently finished, hot-melt adhesive staple fibers, crimped in a stuffer box, were produced on a pilot fiber drawing line, the cover of which had a DSC melting point of approximately 200° C. It was even possible to produce amorphous co-PETs of a clearly reduced adhesion temperature by a further increase of the caprolactone modification in the range of 35 to 40 mol-%.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. The means and materials for carrying out various disclosed functions may take a variety of alternative forms without departing from the invention. It is to be understood that the phraseology or terminology employed herein is for the purpose of description and not of limitation.

What is claimed is:

1. A method for producing polyester bi-component fibers and filaments from a modified and unmodified melt of one and the same polyester, comprising:

modifying a partial amount of the polyester by adding and homogeneously mixing in a modifying agent and optional other additives,to obtain a copolyester combining the partial amount of said copolyester and an unmodified remaining amount of polyester in at least one bi-component spinneret pack, spinning bi-component threads, combining the individual threads into a tow or a yarn, and optionally continuing processing of the tow or the yarn by at least one of drawing, crimping and heat treating, whereby the modifiying agent is a lactone.

2. A method in accordance with claim 1, wherein said lactone has 6 to 12 C atoms.

3. A method in accordance with claim 1, wherein the partial and remaining amounts of the polyester are used as a melt from mutual poly-condensation.

4. A method in accordance with claim 1, wherein the partial and remaining amounts are present as granules and that the modifying agent is mixed with the partial amount of the granules.

5. A method in accordance with claim 1, wherein the modifying agent is admixed in a melt extruder.

6. A method in accordance with claim 1, wherein the modifying agent is mixed, optionally continuously, into the melt stream and is subsequently homogeneously mixed into the melt.

7. A method in accordance with claim 6, wherein the mixing is carried out in a static mixer.

8. A method in accordance with claim 1, wherein polyethylene terephthalate with at least 90 mol-%, ethylene terephthalate units is used as polyester.

9. A method in accordance with claim 1, wherein the copolyester has the same relative viscosity as the corresponding unmodified polyester and contains statistically distributed „xw-hydroxy carboxylic acid units.

10. A method in accordance with claim 1, wherein the modification of the partial amount is performed within a time period of under 30 minutes.

11. A method in accordance with claim 1, wherein the melt temperature of the partial amount lies in the range of 265° to 310° C.

12. A method in accordance with claim 1, wherein at least one soluble inert additive, selected from the group consisting of color control additives, catalysts and mixtures thereof, is mixed with the polyester.

13. A method in accordance with claim 12, wherein a catalyst is added selected from the group consisting of tin (II) and zirconium (IV) compounds.

14. A method in accordance with claim 1, wherein the bi-component threads are spun in the configurations selected from the group consisting of side-by-side (S/S) and side-by-side hollow (S/S hollow).

15. A method in accordance with claim 14, wherein an ε-caprolactone amount of 4 to 12 mol-%, relating to the modified partial stream, is metered in for modification.

16. A method in accordance with claim 1, wherein the bi-component threads are spun in the configuration core/cover (C/C).

17. A method in accordance with claim 16, wherein an ε-caprolactone amount of 20 to 40 mol-%, relating to the modified partial stream, is metered in for modification.

18. A method according to claim 1, wherein said polyester is polyethylene terephthalate with at least 95 mol-% ethylene terephthalate units, said modifying agent is ε-caprolactone, and wherein the modification of the partial amount is carried out within 20 minutes.

19. A method according to claim 1, wherein the modification of the partial amount is carded out within 3–15 minutes.

20. A method according to claim 1, wherein the melt temperature of the partial amount lies in the range of 270°–295° C.

21. A method according to claim 13, wherein said catalyst is tin (II), dioctoate, zirconium (IV) acetylacetonate, or a mixture thereof.

22. In a method of producing woven fabrics, knitted fabrics or non-woven fabrics comprising processing polyester bi-component threads or yarns into said fabric, the improvement wherein said threads or yarns are formed by bi-component spinning of a first polyester and a co-polyester formed by adding a modifying agent to a partial amount of said first polyester, producible according to the method of claim 1.

* * * * *